United States Patent [19]

Mumford

[11] 4,281,774

[45] Aug. 4, 1981

[54] TAMPER PROOF SNAP CAP

[75] Inventor: George V. Mumford, Toledo, Ohio

[73] Assignee: Owens-Illinois, Inc., Toledo, Ohio

[21] Appl. No.: 130,925

[22] Filed: Mar. 17, 1980

[51] Int. Cl.[3] ..... B65D 41/16; B65D 41/18

[52] U.S. Cl. ..... 220/306; 220/270; 215/256; 215/320

[58] Field of Search ..... 220/270, 306; 215/256, 215/320

[56] References Cited

U.S. PATENT DOCUMENTS

| | | | |
|---|---|---|---|
| 4,046,282 | 9/1977 | Ruch | 220/270 |
| 4,103,803 | 8/1978 | Irvine | 220/270 |
| 4,190,175 | 2/1980 | Allen | 220/306 X |

*Primary Examiner*—George T. Hall

*Attorney, Agent, or Firm*—John R. Nelson; Myron E. Click; David H. Wilson

[57] ABSTRACT

The invention provides an improved plastic snap cap with a tamper proof band for sealing wide mouthed plastic containers that have an outwardly protruding, continuous, circumferential bead near the top of the container rim. The cap panel has a depending sealing plug for forming a seal on the inside surface of the container. The inside of the closure skirt has a dual function groove formed to provide a frangible circumferential line and to receive the protruding bead when the cap is snapped into position on the container. The portion of the skirt below the groove serves as a tamper proof tear strip, and normally prevents removal of the closure. The groove on the inside of the closure skirt does not extend around the entire inner circumference of the skirt, but leaves a small section of the skirt with no groove or recess to receive the protruding bead. Therefore, when the cap is in place on the container, the protruding bead causes this section of the skirt to bulge slightly outward. A vertical score line extends from each end of the discontinuous groove to the bottom of the tamper proof band. The small bulged area and vertical score lines permit the tamper proof band to be easily grasped and torn away from the closure along the peripherally weakened area provided by the discontinuous groove.

5 Claims, 4 Drawing Figures

TAMPER PROOF SNAP CAP

BACKGROUND OF THE INVENTION

Plastic closures with tamper proof bands are well known in the prior art. In general, the lower portion of the closure skirt locks around a circumferential bead projecting from the outside surface of the container wall, just below the rim. The lower part of the skirt, below the protruding container bead, forms a tamper proof band which must be removed before the closure may be removed. Many different designs have been developed for permitting easy removal of the tamper proof band. Typically, the skirt is weakened by score lines on which the band may be torn away. Further, a tab is usually provided which the user may grasp to begin pulling the tamper proof band from the remainder of the closure. To make the tab accessible, the prior art has variously employed such methods as perforating an area around the tab, thickening the skirt walls near the tab, and forming an enlarged tab extending below the bottom of the skirt.

For example, U.S. Pat. No. 3,856,171 to Rossi discloses a tab partially cut away from the skirt and connected by a plurality of frangible strips, and a thickened skirt wall near the tab. U.S. Pat. No. 3,753,511 to Ruch discloses a similar band and tab, with a weakening score line formed on the outside of the skirt. While such prior art devices may be completely effective, the means employed to form the tab or frangible strip have been relatively expensive, and have used a greater amount of material than necessary. A more easily manufactured tamper proof closure, using a minimum amount of material, without loss of convenience in use is deemed desirable.

SUMMARY OF THE INVENTION

The invention provides an improved plastic tamper proof closure for a plastic container that has a finish with an outwardly protruding continuous circumferential bead, such as a plastic can for citrus products. The cap has a top panel section and a relatively short skirt section depending from the periphery thereof. The inside of the skirt has a discontinuous circumferential groove, formed to snugly engage the circumferential bead protruding from the container. When the cap is pressed into sealing engagement with the container, therefore, the protruding bead snaps into the groove on the inside of the cap skirt and prevents removal of the cap. The lower part of the skirt, below the groove, snaps into engagement below the protruding bead, and functions as a tamper proof band. The discontinuous groove does not extend through a small segment of the skirt. Therefore, the protruding bead on the container causes this segment and the portion of the skirt immediately surrounding it to bulge outward slightly. A vertical score line on the inside of the skirt extends from one end of the groove to the bottom of the skirt. The band may be easily grasped at the bulge and torn away along the weakened lines formed by the circumferential groove and the vertical score line.

The closure panel has a depending plug to sealingly engage the inside of the container wall. The plug may be an integral annular member depending from the flat panel section. Alternatively, the panel may be depressed near its periphery, to extend into the container, thereby forming a sealing plug.

DESCRIPTION OF THE PREFERRED EMBODIMENT

Figure 1:
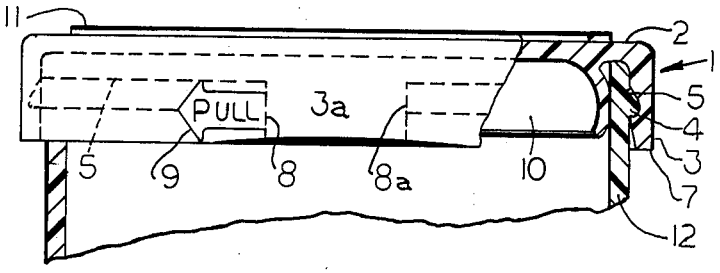
FIG. 1 is an elevational view, partially in section, of a closure embodying this invention, shown in sealing engagement with a plastic container.
Figure 2:
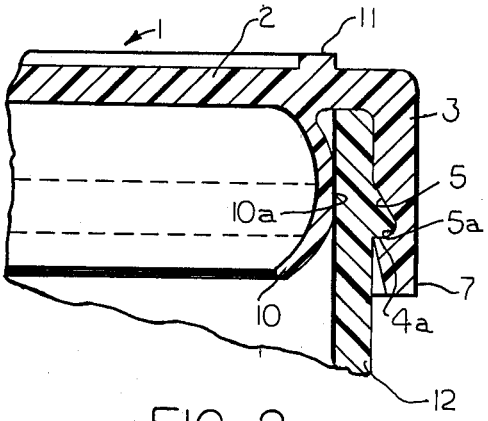
FIG. 2 is an enlarged sectional view showing the container bead in engagement with the groove in the closure skirt.

As illustrated in the drawings, the invention comprises a plastic snap cap 1 for sealing a plastic can 12, or other wide mouthed plastic container. The cap 1 comprises a top panel section 2, and a relatively short skirt 3 depending from the periphery thereof. On the outside of the can 12 near the top is an outwardly protruding, continuous circumferential bead 4. The bead 4 is of a generally triangular cross section, and tapers outwardly and downwardly towards a generally horizontal lower locking surface 4*a*. The inside of the closure skirt 3 has a discontinuous circumferential groove 5 formed to snugly engage the circumferential bead 4 which protrudes from the can 12. The groove 5 is also of a generally triangular configuration, and defines an upwardly facing generally horizontal shoulder 5*a*. When the cap is pressed into position on the can 12, the lower section 7 of the skirt 3 snaps into position below the downwardly facing surface 4*a* of the can bead 4. Removal of the cap is therefore prevented by the interference of bead surface 4*a* and groove surface 5*a*. The lower portion 7 of the skirt 3 therefore functions as a tamper proof band. The depth of groove 5 is sufficient to weaken the skirt to permit removal of tamper proof band 3, as presently described.

Figure 3:
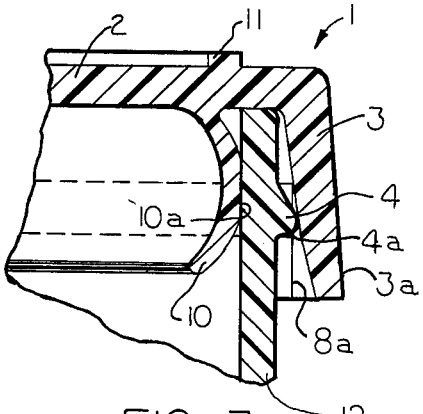
FIG. 3 is a sectional view similar to FIG. 2, but taken on a plane through the small area of the skirt without the groove.

The discontinuous groove 5 does not extend through a small segment 3*a* of the skirt 3. When the cap 1 is in position on the can 12, this segment 3*a* and small portions of the skirt 3 immediately surrounding segment 3*a* are bulged slightly outwardly by the protruding bead 4, as best shown in FIG. 3. At one end of the discontinuous groove 5, a vertical score line 8 is formed on the inside of the skirt 3 and extends downwardly from the end of the groove 5 to the bottom of the skirt 3. Because this end of tamper proof band 7 is bulged slightly outward, near segment 3*a*, it may be easily grasped by the fingers and pulled away from the upper part of the cap along the weakened lines defined by score line 8 and circumferential groove 5. Suitable indicia 9 may be located on the tamper proof band 7 near the vertical score line 8. If the tamper proof band 7 is to be completely removed to allow convenient reuse of the upper portion of the cap 1, a second vertical score line 8*a* is formed on the inside of the skirt 3, extending downwardly from the other end of the groove 5 to the bottom of the skirt 3. The tamper proof band may then be completely torn away along vertical score line 8, weakening groove 5 and vertical score line 8*a*. Skirt segment 3*a* will remain integrally attached to the cap 1.

A downwardly depending, annular sealing plug 10 is formed on the bottom surface of the cap panel 2. The sealing plug 10 has a convex outer surface 10*a* which cooperates with the inside surface of the can 12 to create a seal. The outside diameter of the plug 10 is slightly larger than the inside diameter of the can 12 so that when the cap 1 is in place, convex surface 10*a* is pressed snugly against the inside wall of the can 12 to form a liquid tight seal.

A stacking ring 11 is provided on the top of the panel 2 to permit convenient stacking of sealed cans.

In this embodiment of the invention, the panel 2 has a generally flat top surface.

Figure 4:
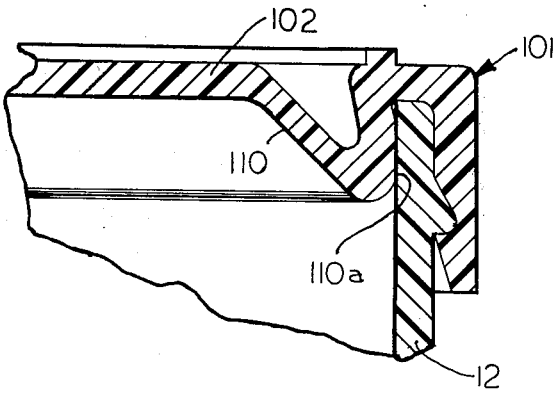
FIG. 4 shows an alternative embodiment of the invention, having a differently formed sealing plug on the closure panel.

In FIG. 4 is shown an alternative embodiment of the invention, in which the sealing plug is of a different configuration. In the alternative embodiment, the top panel 102 of the cap 101 is bulged downwardly and outwardly, to form an annular sealing plug 110 having an outer convex surface 110*a*. Other features of this embodiment are the same as those already disclosed.

From the foregoing, it is apparent that the invention provides an easily manufactured, improved tamperproof cap. The skirt section 3 is of uniform thickness. Since the small bulged segment 3*a* is apparent and readily grasped, no separate depending or thickened tab is necessary. Weakening lines 8, 8*a* and groove 5 are all formed on the inside of skirt 3, where they may be most easily molded.

Modifications of this invention will be apparent to those skilled in the art, and it is intended that the scope of the invention be determined solely by the appended claims.

What is claimed is:

1. A cap for sealing a container having a circumferential outwardly projecting bead formed on its outside surface, near the container rim, said cap comprising a top panel section, a skirt section depending from the periphery of said panel, a discontinuous circumferential groove formed on the inside surface of said skirt and constructed and arranged to cooperate with said container bead, the ends of said groove being a short distance apart, whereby a segment of said skirt is bulged slightly outward by the engagement of said container bead and said skirt segment, a lower skirt section below said groove extending under said container bead to prevent removal of said cap, means for forming a seal between said cap and container, and score means adjacent said segment to permit removal of said lower skirt section.

2. The cap of claim 1 wherein said last mentioned means comprises a vertical score line adjacent said segment, extending from an end of said discontinuous groove to the bottom of said skirt, whereby said lower skirt section may be torn away from the remainder of the cap along the lines weakened by said score line and said groove.

3. The cap of claim 2 wherein a second vertical score line extends from the other end of said groove to the bottom of said skirt, whereby said lower skirt section may be completely removed from the remainder of said cap, by tearing along the lines weakened by said score lines and said circumferential groove.

4. The cap of claim 2 or 3 wherein said score lines are formed on the inside of said skirt.

5. The cap of claims 1, 2, 3, or 4 in which said means for forming a seal comprises a downwardly depending annular sealing plug integrally formed on said cap panel, and an outer convex sealing surface on said plug, whereby said sealing surface is compressed against the inside wall surface of said container when said cap is in sealing engagement with said container.

* * * * *